US006250781B1

(12) United States Patent
Straus et al.

(10) Patent No.: US 6,250,781 B1
(45) **Date of Patent: *Jun. 26, 2001**

(54) INTERCHANGEABLE OUTDOOR LUMINAIRE AND METHOD OF ASSEMBLY THEREOF

(75) Inventors: Joseph A. Straus, Woodland Hills; Angel M. Orellana, Los Angeles, both of CA (US)

(73) Assignee: US Pole Company, Inc., Sun Valley, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/404,743

(22) Filed: Sep. 24, 1999

Related U.S. Application Data

(60) Provisional application No. 60/101,822, filed on Sep. 25, 1998.

(51) Int. Cl.[7] ..... F21V 17/00

(52) U.S. Cl. ..... 362/375; 362/362; 362/374; 362/367

(58) Field of Search ..... 362/362, 367, 362/317, 351, 355, 360, 311, 296, 310, 145, 458, 806, 812, 374, 375

(56) References Cited

U.S. PATENT DOCUMENTS

| | | | |
|---|---|---|---|
| D. 100,102 | 6/1936 | Halvorsen . | |
| D. 165,326 | 12/1951 | Cross | D48/23 |
| D. 248,503 | 7/1978 | Grindle | D48/23 R |
| D. 321,406 | 11/1991 | Schlesselman | D26/67 |
| 1,856,073 | 5/1932 | Graham | 362/374 |
| 3,448,259 | 6/1969 | Nitsch et al. | 240/7.1 |
| 3,679,891 | 7/1972 | Quack | 240/52 |
| 5,975,724 | 11/1999 | Pallanes | 362/310 |

OTHER PUBLICATIONS

"PCT International Search Report," Intl. Application No. PCT/US99/22247, Dec. 15, 1999 (1 page).

"Architectural Area Lighting Promenade™ Series" brochure, pp. 1–12, publication date unknown, but applicants are willing to concede that this is prior art. Thomas EMCO Lighting brochure, pp. 1–11, Feb. 1979.

*Primary Examiner*—Thomas M. Sember
*Assistant Examiner*—Ismael Negron
(74) *Attorney, Agent, or Firm*—Christie, Parker & Hale, LLP

(57) ABSTRACT

An interchangeable outdoor luminaire includes a housing having a circular top rim and a circular bottom rim with a circumferential recess, a plurality of interchangeable tops, and a plurality of interchangeable light transmissive doors. Each top has a circular rim with a flange that corresponds to the top surface of the housing, and each door has a circular rim with a circular edge that corresponds to the bottom surface of the housing. Because the dimensions of the circular rims of the tops are the same, and the dimensions of the circular rims of the doors are the same, any of the tops for the housing can be used with in conjunction with any of the light transmissive doors.

12 Claims, 5 Drawing Sheets

INTERCHANGEABLE OUTDOOR LUMINAIRE AND METHOD OF ASSEMBLY THEREOF

CROSS REFERENCE TO RELATED APPLICATIONS

This application claims priority of U.S. Provisional Application Ser. No. 60/101,822, filed Sep. 25, 1998, the subject matter of which is fully incorporated herein. This application also incorporates by reference U.S. Design application Ser. No. 29/096,196, filed Nov. 6, 1998.

FIELD OF THE INVENTION

This invention relates to an outdoor luminaire, in particular an outdoor luminaire having a housing adaptable to a plurality of interchangeable tops and a plurality of interchangeable light transmissive doors.

BACKGROUND OF THE INVENTION

Architects prefer to have the ability to 'mix and match' elements when designing so that the selection available is maximized and the lighting scheme can be coordinated throughout the structure and/or surrounding area. It is therefore desirable to have an interchangeable outdoor luminaire having a plurality of interchangeable tops and a plurality of interchangeable light transmissive doors.

SUMMARY OF THE INVENTION

An interchangeable outdoor luminaire includes a housing that has an open top and an open bottom to form a circular top rim and a circular bottom rim, respectively, a plurality of interchangeable tops each with an open top that forms a circular rim that matches the top rim of the housing, and a plurality of interchangeable light transmissive doors each with an open bottom that forms a circular rim that matches the bottom rim of the housing. The circular top rim of the housing has a stepped top edge. The circular bottom rim forms a circumferential recess with a stepped bottom edge. Each of the tops have the same circular rim with an annular flange having the same diameter. The annular flange of the tops has a slightly larger diameter than the circular top rim of the housing. The flange fits over the circular top rim of the housing to form an interface between the housing and the top.

The plurality of interchangeable light transmissive doors are each capable of being received into the circumferential recess of the bottom of the housing and each have the same circular rim with a circular outer edge. The circular outer edge of the door is spaced close to the bottom stepped edge of the housing to provide two closely spaced surfaces that facilitate joining the housing and the door. The circular outer edge has a slightly smaller diameter than the stepped bottom edge, thereby enabling the transmissive door to fit into the circumferential recess.

The plurality of interchangeable tops include a pyramidal top, a dome top, an up-light dome top with a decorative cast guard, and an up-light dome top. The plurality of interchangeable transmissive doors include a flat tempered glass, a round drop glass, a flat drop glass, and a tear drop acrylic. Any of the tops for the housing can be used with in conjunction with any of the light transmissive doors.

BRIEF DESCRIPTION OF THE DRAWINGS

These and other features and advantages of the present invention will become appreciated as the same becomes better understood with reference to the specification, claims and drawings wherein:

DETAILED DESCRIPTION OF THE PREFERRED EMBODIMENTS

Figure 1:
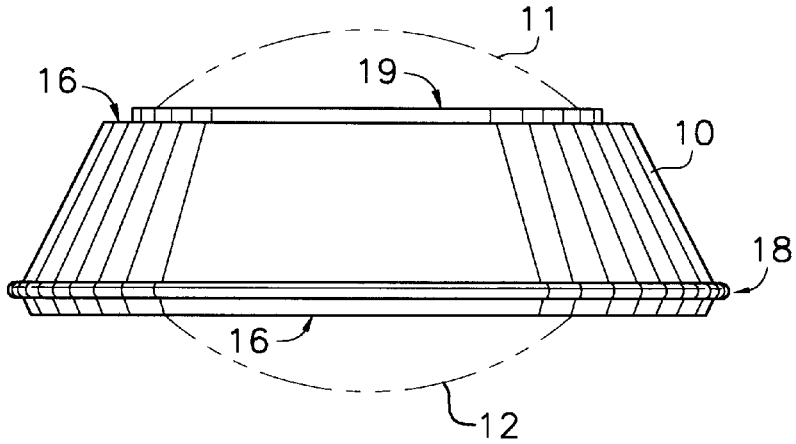
FIG. 1 illustrates a side view of an outdoor luminaire according to the present invention with a housing 10, a top 11, and a light transmissive door 12.

The drawings depict an outdoor luminaire which includes a number of interchangeable parts. As illustrated in FIG. 1, the luminaire includes a top 11, a housing 10; and a light transmissive door 12. The housing attaches to one of a number of different arm structures 100; examples of arm structures are illustrated in FIG. 5. The top and the door are shown in dashed lines because there are a number of different tops and doors that can be used with the same housing. Any of the tops 11 of FIG. 3 for the housing 10 can be used in conjunction with any of the light transmissive doors 12 of FIG. 4. Each of the tops 11 are configured to fit over the housing 10, and each of the light transmissive doors 12 are configured to be received under the housing 10.

Figure 2A:
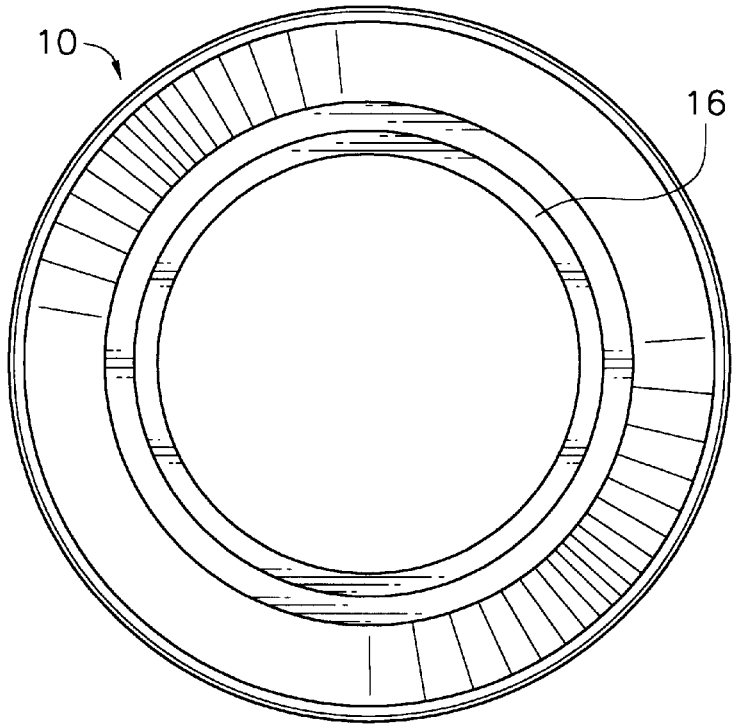
FIG. 2 illustrates a plan view of the housing 10 of FIG. 1.
FIG. 2B illustrates the housing 10 of FIG. 2A where the left half of the figure is a side view of the housing, and the right half is a cross-sectional view of the housing.
Figure 2B:
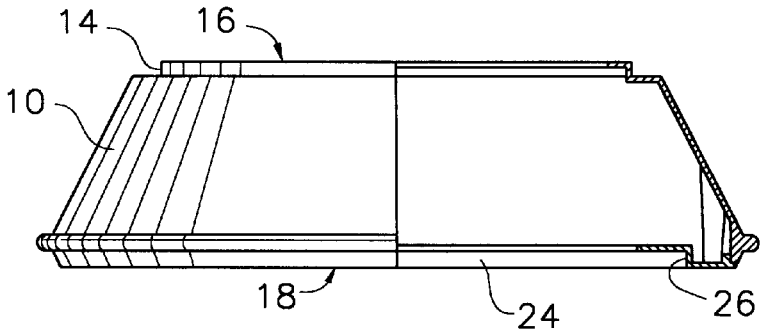

FIGS. 2A and 2B show plan, side and cross-sectional views of the housing 10. The housing is open at the top and open at the bottom to form a circular top rim 16 and a circular bottom rim 18, respectively. The top 11 has an opening that forms a circular rim 19. Rim 19 fits over rim 16 to form an interface between housing 10 and top 11. The door 12 has a circular rim 21. Rim 21 fits into rim 18 to form an interface between housing 10 and door 12.

The circular top rim 16 has a stepped circumferential edge 14 to be received into the circular rim 19 of one of the tops 11 available for selection in constructing the luminaire. The circular bottom rim 18 of housing 10 has a circumferential recess 24 with a bottom stepped edge 26 that is dimensioned to receive the circular rim 21 of one of the light transmissive doors 12 available for selection in constructing the luminaire.

Figure 3A:
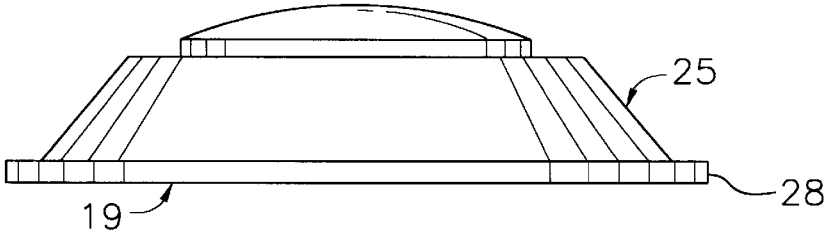
FIG. 3A illustrates a side view of a pyramidal top 25.
Figure 3B:
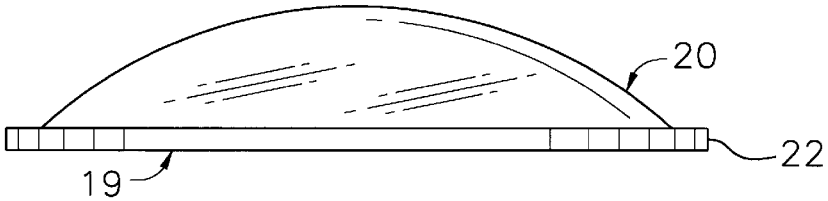
FIG. 3B illustrates a side view of a dome top 20.
Figure 3C:
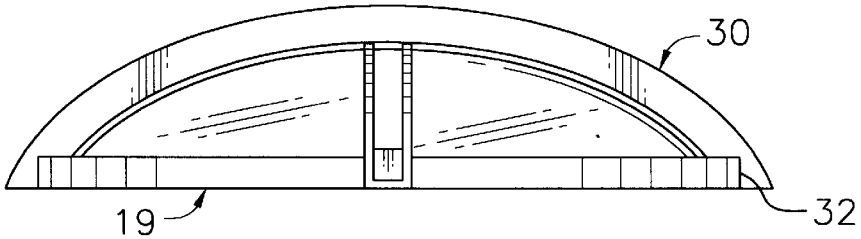
FIG. 3C illustrates a side view of an up light dome top with a decorative cast guard 30.
Figure 3D:
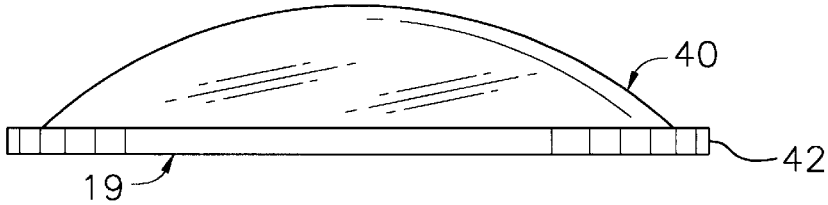
FIG. 3D illustrates a side view of an up light dome top 40.

As shown in FIGS. 3A–3D, respectively, the top 11 is preferably one of a pyramidal top 25, a dome top 20, an up-light dome top with a decorative cast guard 30, and an up-light dome top 40. As shown in FIGS. 4A–4D, respectively, the light transmissive door 12 is preferably one of a flat tempered glass 50, a round drop glass 60, a flat drop glass 70, and a tear drop acrylic 80. As illustrated in FIG. 3A, the circular rim 19 of the pyramidal top 25 has a downwardly directed annular flange 28 with a diameter slightly larger than the stepped circumferential edge 14. The flange 28 fits over and interfaces with the stepped circumferential edge 14 as a result of the top being placed onto the housing. Similarly, in FIGS. 3B–3D, the circular rim 19 of the dome top 20, the up-light dome top with the decorative cast guard 30, and the up-light dome top 40 has a downwardly directed flange 22, 32, 42, respectively. Thus, each top 20, 30, 40 interchangeably fits onto housing 10 and interfaces with the housing 10 in the same manner as described above. See also FIG. 6A.

Figure 4A:
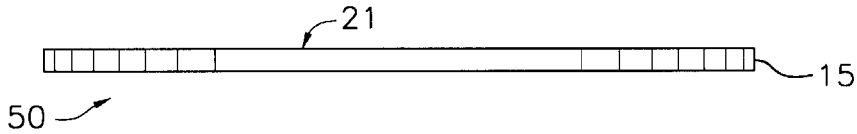
FIG. 4A illustrates a side view of a flat tempered glass light transmissive door 50.
Figure 4B:
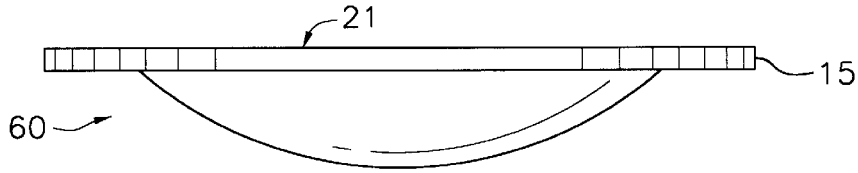
FIG. 4B illustrates a side view of a round drop glass light transmissive door 60.
Figure 4C:
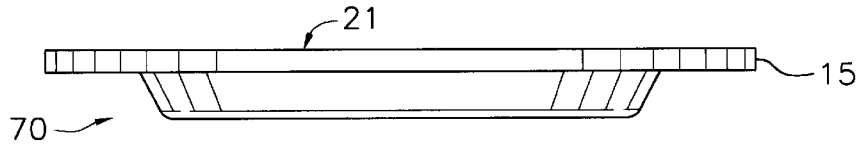
FIG. 4C illustrates a side view of a flat drop glass light transmissive door 70.
Figure 4D:
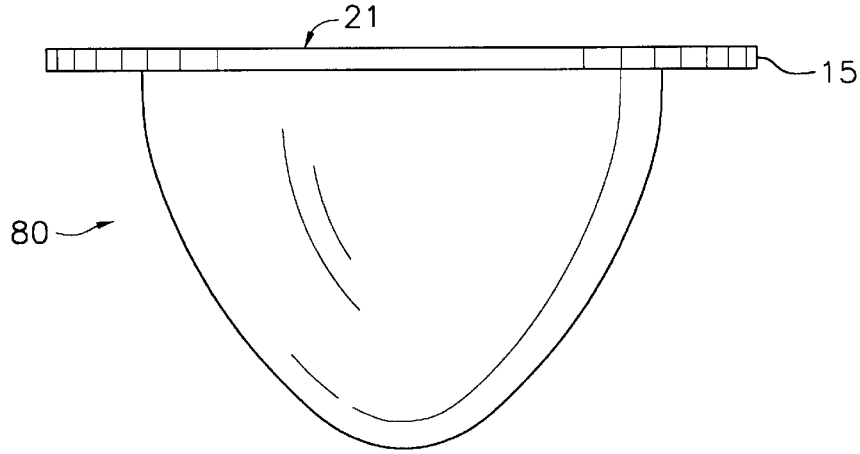
FIG. 4D illustrates a side view of a tear drop acrylic light transmissive door 80.
Figure 5A:
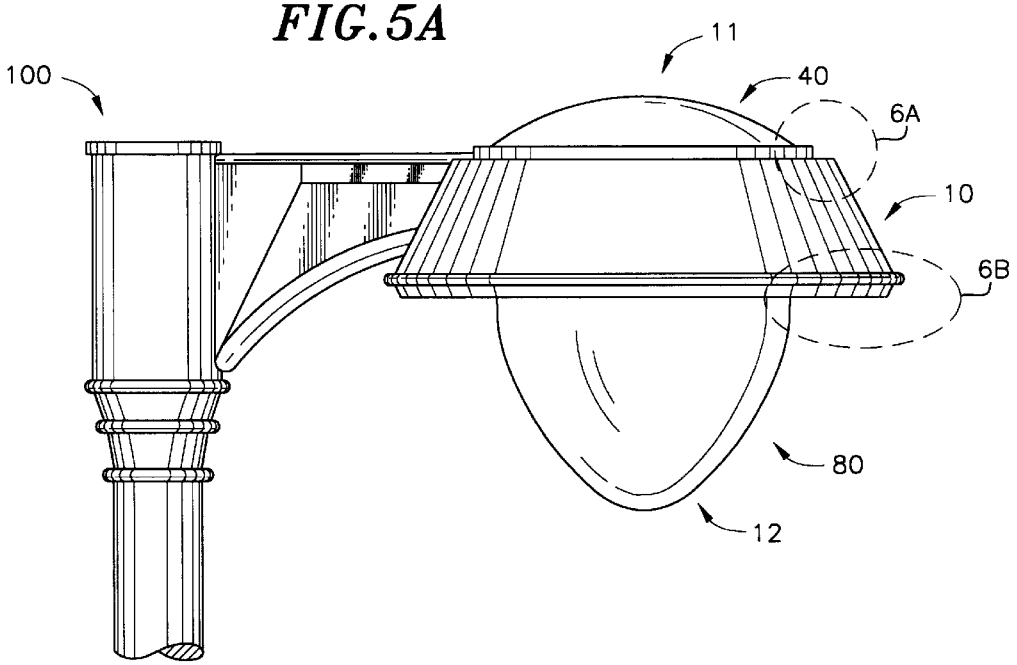
FIG. 5A illustrates a side view of FIG. 1 where the top 11 is an up light dome top 40 and the light transmissive door 12 is a tear drop acrylic light transmissive door 80.
Figure 5B:
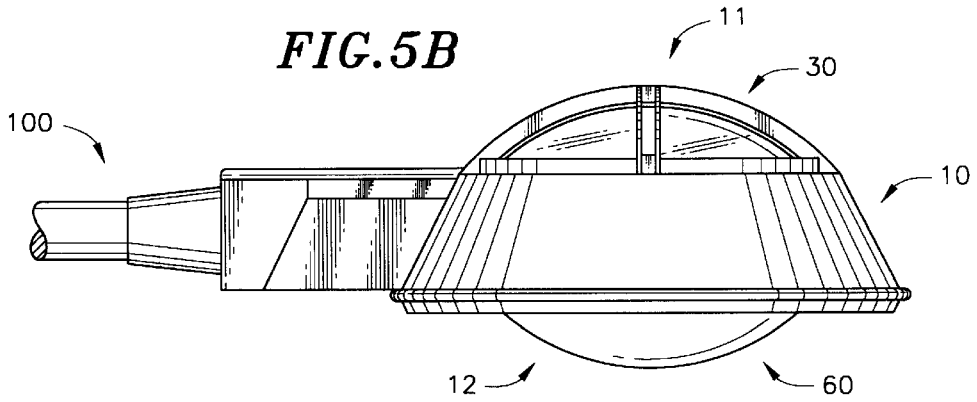
FIG. 5B illustrates a side view of FIG. 1 where the top 11 is a up light dome top with a decorative cast guard 30 and the light transmissive door 12 is a round drop glass light transmissive door 60.

As shown in FIGS. 4A–4C, each door 12 has the circular rim 21 with a circular outer edge 15 that is of a slightly smaller diameter than the bottom stepped edge 26. The rim 21 is annular in shape. Flat tempered glass 50 extends across the annulus in the same plane as rim 21. Round drop glass 60 curves downwardly from rim 21 across the annulus. Flat drop glass 70 extends across the annulus in a plane below rim 21. Tear drop acrylic 80 curves downwardly from 21 across the annulus. The circular outer edge 15 of the door 12 is closely spaced to the bottom stepped edge 26 when received into the circumferential recess 24.

A reflector 17 is set in the housing 10 to reflect the light source in the housing and to produce different light patterns depending on the type of light transmissive door. (See FIG. 6B.) For example, the flat door directs the light and cuts it off at a certain angle, while the drop doors emit widely angled light.

Figure 6A:
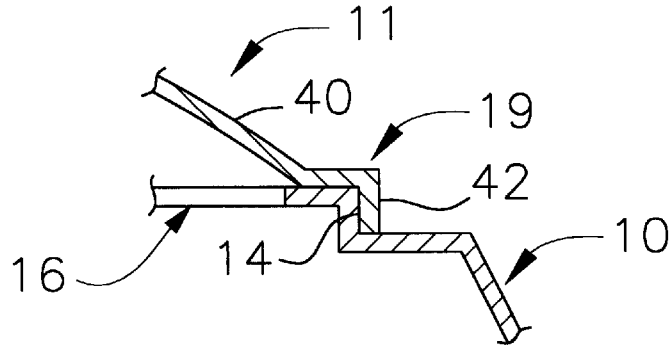
FIG. 6A is an exploded view of section 6A of FIG. 5A.
Figure 6B:
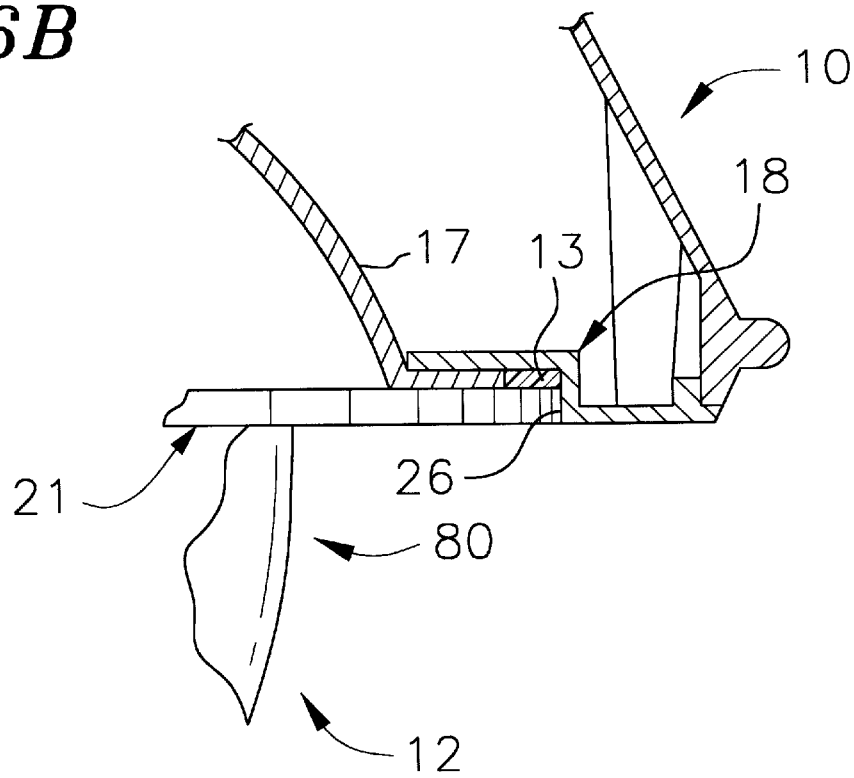
FIG. 6B is an exploded view of section 6B of FIG. 5A.

A gasket seal 13 is placed between the door 12 and the housing 10, as shown in FIG. 6B, to seal the interior against dust, moisture, and bugs. The gasket seal 13 connects to the housing 10 at an edge of the reflector 17 near the bottom stepped edge 26.

A back portion of the circular rim 21 hingedly connects to a corresponding portion of the bottom stepped edge 26. The hinged connection allows easy access to the lighting fixture for repair and maintenance. Through a front latch (not shown), a front portion of the circular outer edge connects with a corresponding front portion of the bottom stepped edge. Preferably, the front latch is a thumb screw.

The dome top 20, and the pyramidal top 25 are preferably made of metal. The dome tops 30 and 40 are preferably made of plastic or glass so that there is illumination above the outdoor luminaire.

The top stepped edge 14 of the housing and the flange of the top form two closely spaced, relatively large surfaces with an angle therebetween, as shown in FIG. 6A. This interface facilitates joining the housing and the top by welding, bonding, or screwed connection. If the top is welded to the housing, as is preferable for the metal tops, the space between the top stepped edge and the flange is filled with weld material. If the glass or plastic up-light dome top is selected for a luminaire, the top is not welded to the housing because of the risk of breaking the glass or melting the plastic. Instead, the top is bonded to the housing by silicone or another compatible material. Alternatively, the top could be screwed to the housing so that the glass or plastic top can be easily replaced or maintained.

Although the present invention has been described and is illustrated with respect to various embodiments thereof, it is to be understood that it is not to be so limited, because changes and modifications may be made therein which are within the full intended scope of this invention as hereinafter claimed. For example, there are many other possible designs for the light transmissive door and for the tops, and each of these doors and tops can be designed with a housing interface that corresponds to the housing and can be coupled therewith.

What is claimed is:

1. An interchangeable outdoor luminaire comprises:

a housing having a circular top rim with a top stepped edge, and a circular bottom rim with a circumferential recess having a bottom stepped edge;

a plurality of interchangeable tops, wherein each top has a circular rim and an annular flange that has a slightly larger diameter than the diameter of the top stepped edge to enable the flange to closely fit over the circular top rim when the housing and the top are brought together, wherein each annular flange of the plurality of tops have the same dimensions; and a plurality of interchangeable light transmissive doors, wherein each light transmissive door has a circular rim and a circular outer edge that has a slightly smaller diameter than the diameter of the bottom stepped edge to enable the circular outer edge to be closely received into the circumferential recess of the circular bottom rim when the housing and the door are brought together, wherein each circular rim of the plurality of doors has the same dimensions.

2. The outdoor luminaire of claim 1 wherein the top is a pyramidal top.

3. The outdoor luminaire of claim 1 wherein the top is a dome top.

4. The outdoor luminaire of claim 1 wherein the top is an up-light dome top with a decorative cast guard.

5. The outdoor luminaire of claim 1 wherein the top is an up-light dome top.

6. The outdoor luminaire of claim 1 wherein the light transmissive door is a flat tempered glass.

7. The outdoor luminaire of claim 1 wherein the light transmissive door is a round drop glass.

8. The outdoor luminaire of claim 1 wherein the light transmissive door is a flat drop glass.

9. The outdoor luminaire of claim 1 wherein the light transmissive door is a tear drop acrylic.

10. The outdoor luminaire of claim 1 wherein the light transmissive door hingedly connects to the housing.

11. The outdoor luminaire of claim 1 wherein the top is connected to the housing with screws.

12. A method of assembly for an outdoor luminaire comprising:

providing a housing having a circular top rim with a top stepped edge, and a circular bottom rim with a circumferential recess having a bottom stepped edge;

providing a plurality of interchangeable tops, wherein each top has a circular rim and an annular flange that has a slightly larger diameter than the diameter of the top stepped edge, wherein each annular flange of the plurality of tops have the same dimensions;

sliding the annular flange of one of the plurality of interchangeable tops onto the top stepped edge of the circular top rim of the housing to enable the top stepped edge to be closely received into flange when the housing and the top are brought together;

providing a plurality of interchangeable light transmissive doors, wherein each light transmissive door has a circular rim and a circular outer edge that has a slightly smaller diameter than the diameter of the bottom stepped edge, wherein each circular rim of the plurality of doors has the same dimensions; and hingedly connecting the circular rim of one of the plurality of interchangeable doors to the bottom surface of the housing to enable the circular outer edge to be closely received into the circumferential recess of the circular bottom rim when the housing and the door are brought together.

* * * * *